United States Patent [19]

Loebach

[11] Patent Number: 4,501,415

[45] Date of Patent: Feb. 26, 1985

[54] BALANCED DEFLECTION GRIPPER FOR SHEET HANDLING EQUIPMENT

[75] Inventor: Michael H. Loebach, Fort Plain, N.Y.

[73] Assignee: Motter Printing Press Co., York, Pa.

[21] Appl. No.: 517,945

[22] Filed: Jul. 28, 1983

Related U.S. Application Data

[63] Continuation-in-part of Ser. No. 299,650, Sep. 4, 1981, abandoned.

[51] Int. Cl.[3] ..... B65H 39/08; B41F 1/28

[52] U.S. Cl. ..... 270/60; 101/415.1; 101/246; 271/82; 271/277; 198/479

[58] Field of Search ..... 101/232, 246, 415.1, 101/408–411; 270/19, 47–50, 60; 271/82, 204, 271/277; 198/479, 480, 650, 653, 696; 493/428, 429, 493/432,424

[56] References Cited

U.S. PATENT DOCUMENTS

| | | | |
|---|---|---|---|
| 744,538 | 11/1903 | Halvorson | 101/412 |
| 948,157 | 2/1910 | Bevan | 101/415.1 |
| 1,374,253 | 4/1921 | Tornberg | 101/419 |
| 1,519,944 | 12/1924 | Warsen | 101/412 |
| 1,600,790 | 9/1926 | Blaine | 101/412 |
| 2,092,568 | 9/1937 | Belluche | 271/277 X |
| 3,202,098 | 8/1965 | Keeler | 101/415.1 |
| 3,637,202 | 1/1972 | Mowry | 271/277 |
| 3,650,211 | 3/1972 | Newtwich | 271/82 X |
| 3,664,260 | 5/1972 | Miller et al. . | |
| 3,833,213 | 9/1974 | Smith | 271/254 |
| 3,924,849 | 12/1975 | Murakame | 271/277 |
| 3,971,553 | 7/1976 | Cosmo | 271/82 X |
| 3,999,454 | 12/1976 | Tiso | 271/82 X |
| 4,253,396 | 3/1981 | Wieland | 101/246 |
| 4,381,106 | 4/1983 | Loebach | 270/47 |

FOREIGN PATENT DOCUMENTS

| | | | |
|---|---|---|---|
| 1000158 | 8/1965 | United Kingdom | 271/82 |

OTHER PUBLICATIONS

"Mechanism & Actuator for Clamping Sheets on a Drum", IBM Tech.-Disc. Bulletin, vol. 23, No. 7A, Dec. 1980, pp. 2679–2682.

*Primary Examiner*—E. H. Eickholt

*Attorney, Agent, or Firm*—Brumbaugh, Graves, Donohue & Raymond

[57] ABSTRACT

A gripper mechanism for printing press folding machines or other sheet handling equipment comprises a rigid holder mounted on a pivot shaft and a resilient gripper finger, fixed to the holder, which pivots into engagement with an angled clamping surface. The geometry of the gripper finger relative to the holder is such that the rigid holder and resilient finger act as a linkage which, upon application of counterforce by the clamping surface, imparts a radial component of force to the gripper tip equal and opposite to the radial component of counterforce, thereby producing non-sliding engagement of a sheet of paper positioned between the clamping surface and said tip.

17 Claims, 9 Drawing Figures

BALANCED DEFLECTION GRIPPER FOR SHEET HANDLING EQUIPMENT

BACKGROUND OF THE INVENTION

This application is a continuation-in-part of U.S. application Ser. No. 299,650, filed Sept. 4, 1981 now abandoned.

The present invention relates to grippers used in printing press folding machines and in other sheet handling equipment, and more particularly to a gripper which clamps one or more sheets of paper in a non-sliding engagement.

In a web-fed printing press, multiple copies of matter are printed simultaneously on a continuous web of sheet material. The web is slit into ribbons, which are in turn cut into sheets of the printed product. The cut sheets are delivered to the collect cylinder of a folding machine, which grips the sheets and transports them to a jaw cylinder. The folding machine subsequently folds the products at an appropriate point prior to the binding operation. One aspect of the assembly of the final product from the printed web involves the ability of the collect cylinder to deliver successive intermediate products to the jaw cylinder directly, which is referred to as "straight delivery" or to collect two or more intermediate products and deliver the collected products to the jaw cylinder, which is referred to as "two collect" or "three collect". The collect cylinder should be capable of handling products of various sizes, both as to sheet size and the number of sheets that make up the end product.

The collect cylinder of the folding machine generally includes grippers positioned axially upon its surface. The grippers clamp the sheets of paper to the surface of the cylinder prior to the folding operation. Each gripper is pivotally mounted within the collect cylinder, and is actuated by a cam in a pre-determined, timed relationship.

My co-pending U.S. application Ser. No. 271,407, filed June 8, 1981, discloses a rotary folding machine for a printing press, having a novel collect cylinder that can easily and quickly be adjusted to handle products of various sizes and to change the mode of product delivery. As disclosed in the specification of U.S. application Ser. No. 271,407, which is incorporated herein by reference, a collect cylinder typically has multiple spaced pairs of grippers around the outside circumference of the collect cylinder.

It is important that the gripper used in the collect cylinder of a folding machine clamp the sheets of paper securely to the surface of the cylinder. When the position of the product on the collect cylinder is altered, the product can be folded at an incorrect point, thus ruining the final result. In addition, if the product slides along the surface of the collect cylinder, the sheets will not register, also producing an undesirable final result.

Three types of grippers have been developed for use in folding machines. In a spring type gripper, a resilient gripper, which is fixed to a pivot shaft, rotates into engagement with a fixed clamping surface on the cylinder, and the gripper acts as a spring to clamp the product to the cylinder. In a rigid gripper, a nonresilient gripper is rigidly fixed to a pivot shaft and pivots into engagement with a clamping surface which is spring loaded on the cylinder. Such existing gripper constructions tend to be high wear items requiring frequent maintenance. In such constructions, the gripper is prone to slide on the surface being gripped, as the resilient clamping force is increased, changing the position of the product and resulting in poor fold or sheet register. Each time a different thickness of printed matter is to be collected, many of such known grippers must be readjusted.

In the third type of gripper mechanism, a rigid gripper, which engages a rigid surface of the cylinder, is rotatably mounted, rather than fixedly mounted, on the pivot shaft. The gripper is spring biased on the pivot shaft, such that when the shaft is pivoted and the gripper engages the fixed clamping surface, the pivot shaft continues to rotate against the force of the spring mechanism, loading the spring. The increasing spring force is transmitted through the rigid gripper to the rigid clamping surface. While this arangement, which is illustrated in U.S. Pat. No. 1,600,790 to Blaine, can produce non-sliding engagement, it is more complicated in construction than the aforedescribed arrangements, and by design tends to wear.

SUMMARY OF THE INVENTION

The present invention is a new and improved gripper mechanism for use in a printing press folding machine or in other sheet handling equipment, which may be used to clamp variable members of sheets of papers to the collect cylinder, and which, due to its structural geometry, produces non-slip engagement of the sheets by the gripper.

More particularly, the present invention is a gripper mechanism which may be mounted on the collect cylinder of a folding machine. A holder is mounted on a pivot shaft, which is mounted to the collect cylinder for pivoting rotation in an axis parallel to the rotational axis of the collect cylinder. A resilient gripper finger is fixed at one end to the holder. The tip of the gripper finger is arranged to engage a clamping surface, which may be part of the gripper mechanism proper or a portion of the surface of the collect cylinder.

When the product is to be gripped or "taken" by the gripper assembly, the holder shaft pivots to move the gripper tip to open and reclose the gripper. This opening and closing motion is then repeated at the point where the product is released to a jaw cylinder. The clamping surface is preferably angled, or beveled, toward the gripper tip such that the tip approaches the clamping surface at an obtuse angle.

Upon engagement of the gripper tip and clamping surface, the clamping surface imparts a counterforce to the gripper tip which has a component in a direction perpendicular to the radius and a component in the radial direction, the radial component being a function of the angle of the clamping surface. The gripper finger, however, has a geometry such that further rotation of the holder about its axis, to increase the resilient holding force of the finger against the surface, causes a deflection of the gripper which imparts a force, in the radial direction, the end of the gripper which is equal and opposite to the radial component of the counterforce imparted to the tip. As a result, the net radial force is zero and the tip remains substantially stationary on the surface as the gripping force is increased.

Preferably, the gripper finger is substantially Z-shaped with upper and lower finger portions arranged at right angles to the connecting portion. The connecting portion is joined to the upper and lower portions by oppositely oriented curved portions (that define the Z)

which lie on opposite sides of the tip radius. The upper and lower finger portions of the Z are oriented at other than 90° to the radius. The lower finger portion, which is clamped to the holder, moves relatively stiffly with rotation of the holder, to cause the curved portions, upon engagement of the tip and clamping surface, to flex or bow. Accordingly, an advantageous bending is produced to provide the compensating deflection of the gripper finger.

Preferably, the clamping surface is beveled to extend below the cylindrical surface of the collect cylinder. Accordingly, when the gripper tip moves into engagement with the beveled surface, it engages the surface and thereby the paper at an obtuse or at substantially a right angle. Moreover, once clamped the leading edge of the sheet is disposed below the cylinder surface and removed from the air stream, i.e. tucked into a cavity. Beveling of the clamping surface below the outside cylinder surface also promotes better friction between the paper and the cylinder due to the fact that the leading edge of the paper is wrapped around the beveled edge.

For a better understanding of the invention, reference is made to the following detailed description of a preferred embodiment, taken in conjunction with the drawings accompanying the application.

DETAILED DESCRIPTION OF A PREFERRED EMBODIMENT

Figure 1:
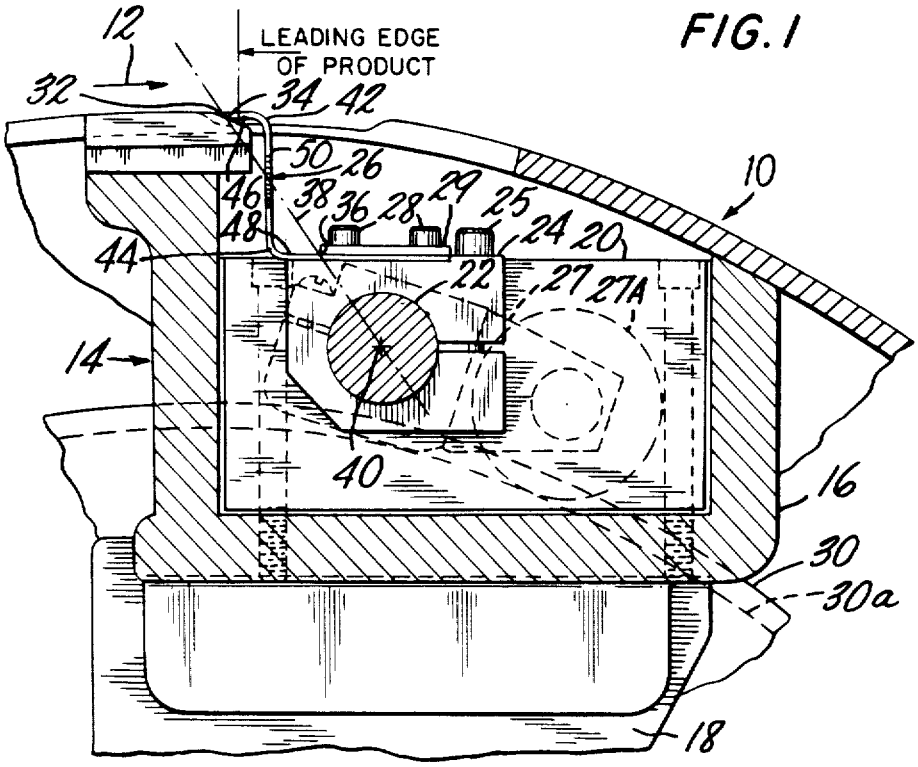
FIG. 1 is a partial sectional view of a collect cylinder, taken along a plane perpendicular to the axis of the cylinder, and illustrating a gripper mechanism in accordance with the present invention.

FIG. 1 illustrates a portion of a collect cylinder 10 of a folding machine. The collect cylinder rotates about an axis in a direction indicated by arrow 12. As described in greater detail in my co-pending application Ser. No. 271,407, after the printed web leaves the printing press it is slit into "ribbons", and cut into an intermediate product, i.e. a stack of sheets cut from the ribbons. Each intermediate product is delivered separately to the collect cylinder 10. Shortly after the intermediate products contact and run with the collect cylinder, a gripper mechanism 14 that is then in position under the leading edge of the intermediate product opens and then recloses to grip the leading edge of the product. After the product is "taken" by the gripper assembly 14, it is carried around on the collect cylinder to a jaw cylinder (not shown) to which it may be transferred by a tucker mechanism (not shown).

Each gripper mechanism 14 includes a housing 16 that may be fastened to a spider 18 of the collect cylinder 10. A pair of end plates 20 carries a transverse gripper shaft 22 that in turn carries a series of holders 24, each in the form of a bracket that may be clamped by screws 25 to the pivot shaft 22 and arranged to support a gripper finger 26. The gripper finger 26 is resilient, for example being made of spring steel, and is attached to the holder 24 by a plate 29 held by bolts 28. The shaft 22 of the gripper mechanism extends out through bearings in the outboard end plates 20 and receives a lever 27 carrying a cam follower 27A.

In a preferred arrangement shown and described in my co-pending application Ser. No. 271,407, the rotation of the pivot shaft 22 is controlled by a pair of cam followers, rather than a single cam follower. The two cam followers are controlled by a pair of cams, rotating masking cam 30 having a cam surface 30A and a stationary gripper cam (not shown). As shown in FIG. 1, movement of the cam follower 27A inwardly causes corresponding pivoting movement of the holder 24 and thereby of the gripper finger 26 away from a beveled edge, or clamping surface 32 of the gripper mechanism 14. Correspondingly, movement of the follower mechanism 27A outwardly causes the tip 34 of the gripper finger 26 to pivot about an arc into engagement with the clamping surface 32.

As shown in FIG. 1, the gripper finger 26 extends from the rigid holder 24 at a point 36. The gripper tip 34 lies on a radius 38, through rotational axis 40 of the shaft 22 and the holder 24. As discussed below, due to the structural geometry of the gripper mechanism there is no substantial component of radial motion imparted to the tip 34 upon engagement of the tip 34 and clamping surface 32. This facilitates the gripping of the leading edge of the paper product by the tip 34, which is preferably beveled, without a resultant sliding between the tip 34 and the surface 32.

As shown, the clamping edge 32 is beveled, that is, is angled toward the gripper tip 34. As a result, as the gripper tip 34 rotates toward the gripper surface 32, from a position spaced from the surface 32, the tip 34 approaches surface 32 from close to a perpendicular angle. However, at the moment of engagement the clamping surface 32 need not lie on radius 38, i.e., perpendicular to the direction of approach of the gripper tip 34, but can lie at an obtuse angle, as shown. It may also, if desired, co-extend with the surface of the cylinder 10. Also, rather than providing the clamping surface 32 as part of the gripper mechanism 14, the surface could be formed as part of the cylinder 10 per se.

In order to produce non-sliding engagement, the gripper finger 26 is constructed to have special deflection characteristics which can be described with reference to FIGS. 3*a*–*c* and 4*a*–*c*, which represent the instant of engagement of the clamping surface 32.

Figure 3A:
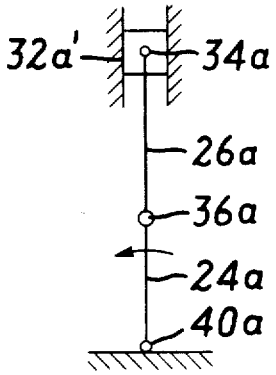
FIGS. 3*a*–3*c* are diagramatic representations depicting the movement imparted by a gripper of various geometrics.
Figure 3B:
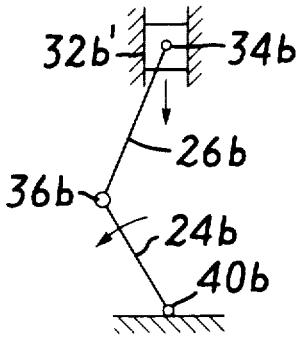
Figure 3C:
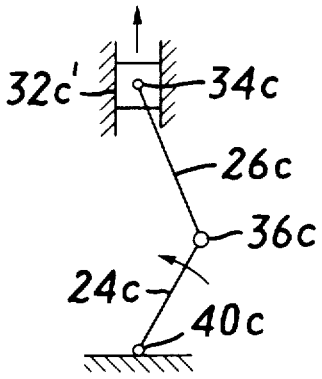

FIG. 3*a* illustrates a slidable linkage in which the links are fully extended and co-linear. Since the tip 34*a* and point 36*a* are aligned radially, rotation of the crank 24*a* imparts no component of radial motion to tip 34*a* either toward or away from point 40*a*. In contrast, FIGS. 3*b* and 3*c* illustrate linkages in which the points 36*b* and 36*c* do not lie on the same radius as tip 34*b* or 34*c*. Rotation of the crank 24*b* imparts a radial component of motion tip 34*b* toward the center of rotation 40*b*. Rotation of crank 24*c* imparts a component of radial motion to tip 34*c* outwardly away from pivot point 40*c*.

Figure 4A:
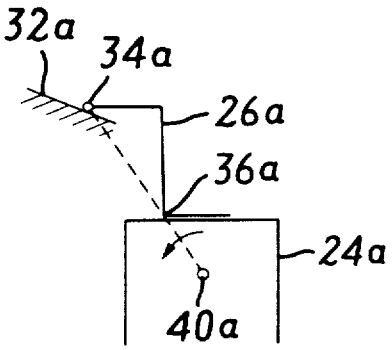
FIGS. 4*a*–4*c* are schematic representations of gripper constructions corresponding to FIGS. 3*a*–3*c*.
Figure 4B:
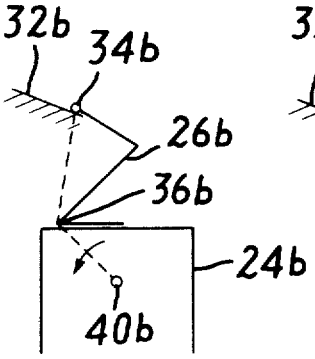
Figure 4C:
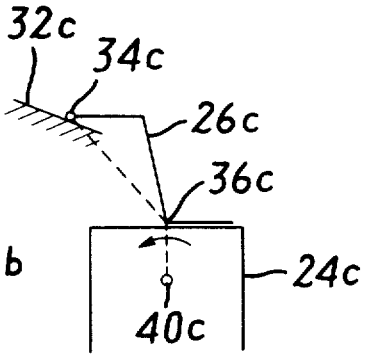

FIGS. 4*a*, 4*b* and 4*c* show crank mechanisms with geometries corresponding to the linkages of FIGS. 3*a*, 3*b*, and 3*c*, respectively. Accordingly, rotation of holders 24*a*, 24*b*, and 24*c* will tend to produce a component of motion at the tip corresponding to that produced in the corresponding linkage.

Figure 5:
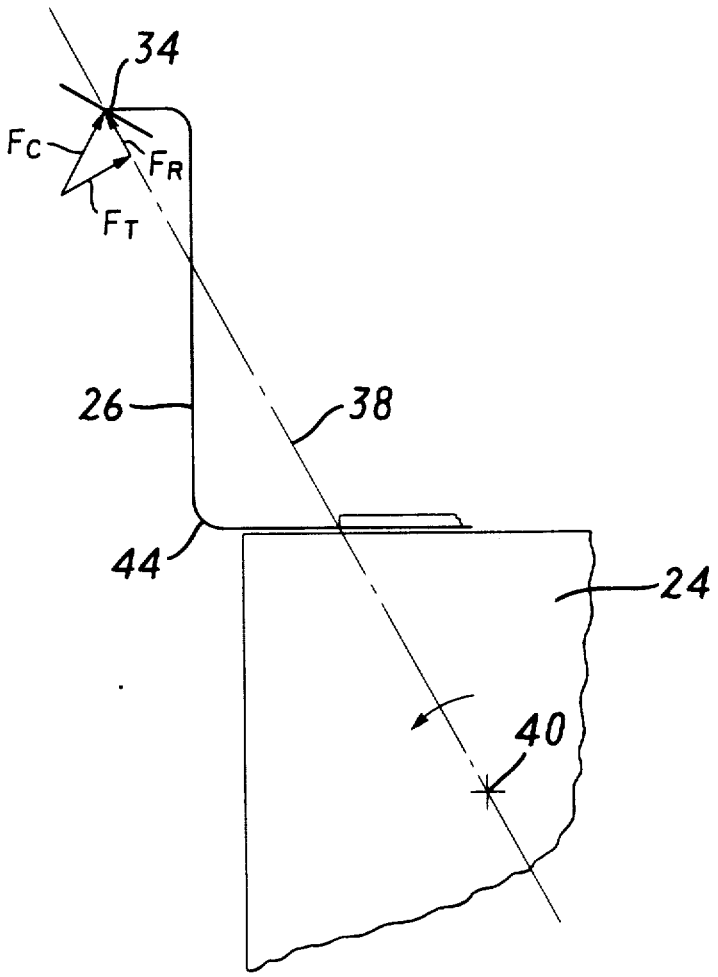
FIG. 5 is a schematic representation of the gripper construction shown in FIG. 1.

However, unlike surfaces 32*a*′, 32*b*′, and 32*c*′ of the linkage mechanisms shown in FIGS. 3*a*–*c*, the engagement surfaces 32*a*, 32*b*, and 32*c* of the gripper mechanisms shown in FIGS. 4*a–c* are at an angle relative to a radius extending through tip 34. As a result, the engagement surface imparts a counterforce $F_c$ to the tip 34 that itself has a component in the tangential direction $F_T$ (to oppose the rotational force of holder 24) and a second component in the radial direction $F_R$. This counterforce is depicted in FIG. 5. As is evident from FIG. 5, the radial component of counterforce $F_R$ tends to displace the tip 34 outwardly.

As shown in FIG. 5, in order to compensate for this force $F_R$, the gripper mechanism is shaped in accordance with FIG. 4*b*, such that the geometry of the gripper finger itself produces a force, in the radial direction, equal and opposite to the force $F_R$. As a result, the forces are balanced, the net radial force at tip 34 is zero (or substantially zero), and the tip remains stationary on the clamping surface 32.

Figure 2:
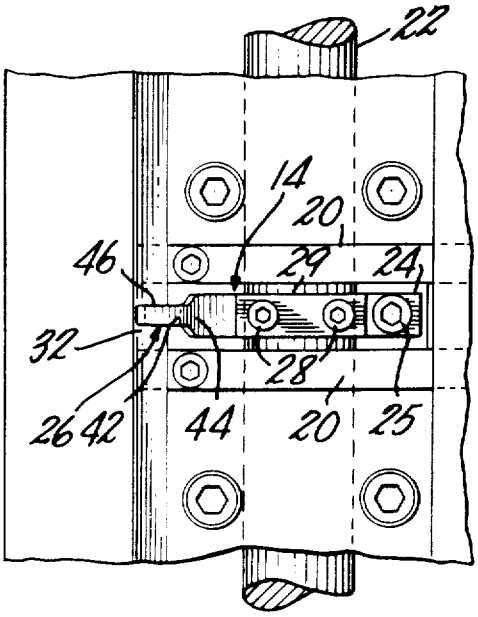
FIG. 2 is a plan view of a portion of the gripper mechanism shown in FIG. 1.

As shown in FIGS. 1 and 2, the gripper finger 26 has a pair of oppositely oriented curved portions 42 and 44 that lie on opposite sides of radius 38. The curved portions connect upper and lower finger portions, 46 and 48, respectively, with a connecting portion 50 to define a Z-shaped finger extension. In the illustrative embodiment, the upper and lower finger portions 46 and 48 are oriented at close to 90° to the radius. The lower finger portion 48 extends forward of the radius, so that upon rotation of holder 24 a motion similar to that shown in FIG. 3*b* is imparted to the curved portion 44. The lower finger portion 48, which is clamped to holder 24, remains relatively stiff, and accordingly the gripper acts similar to the linkage of FIG. 3*b*. When the tip 34 engages the clamping surface 32, curved portion 44 bows inwardly, and curved portion 46 bows outwardly, and force, both normal and radial, is imparted to tip 34 against clamping surface 32. The radial component of bending force is equal and opposite to the radial component of counterforce. The normal component will produce a frictional holding force to offset any inequalities between the radial components, and further ensure non-sliding engagement.

As shown in FIGS. 1 and 2, the lower portion of the gripper finger 26, near the holder 24, is wider and relatively stiff. However, such is merely exemplary. The particular characteristics of the gripper finger 26 will vary with the angle of surface 32, since such angle affects the magnitude of $F_R$. While a particular shape of finger has been shown and described, other shapes of resilient members may be utilized, to conform to the particular gripping requirements.

The beveled edge of the surface 32 also facilitates better gripping. As shown, where the clamping surface 32 is beveled relative to the collect cylinder surface 10, the printed sheet will be wrapped around the beveled edge 32 to increase frictional contact and remove the leading edge of the sheet from the air stream. Also, the gripper tip 34 approaches at an obtuse angle, close to a right angle, as compared with a corresponding engagement of the cylindrical surface of the collect cylinder 10, so that rotational force is substantially aligned with the direction of resilient gripping force. The clamping surface 32 may be at right angles to the direction of approach of tip 34. However, the angle of the surface 32 to the direction of movement of the tip is normally substantially less than 90° to prevent creasing the product. If desired, the clamping surface may co-extend with, or be, the surface of the cylinder 10.

The foregoing represents the description of a preferred embodiment of the invention. Variations and modifications of the invention will be apparent to persons skilled in the art without departing from the inventive concepts disclosed herein. All such modifications and variations are intended to be within the scope of the invention as defined in the following claims.

I claim:

1. A balanced deflection gripper mechanism for sheet handling equipment comprising:

a clamping surface on which sheets of paper and the like may be positioned;

gripper means comprising a holder supported relative to said surface and a resilient gripper finger having one end fixed to said holder, wherein said gripper finger terminates in a tip;

means for rotating said holder about an axis for rotating said tip in an arc into engagement with said surface;

wherein said tip lies along a radius extending through said axis;

wherein upon engagement of said tip and surface further rotation causes said surface to impart a counterforce to said tip having a first component perpendicular to said radius and a second component along said radius and said further rotation causes displacement of said one end relative to said countersurface; and wherein said gripper finger is formed such that said further rotation causes said gripper finger to deflect, imparting a force to said tip with a radial component which is substantially equal and opposite to said second component of counterforce, thereby producing non-sliding engagement between said gripper tip and said surface.

2. A gripper mechanism as defined in claim 1, wherein said clamping surface is angled toward said tip.

3. A gripper mechanism as defined in claim 2, wherein said tip is beveled for cooperative engagement of said clamping surface.

4. A gripper mechanism as defined in claim 2, wherein said finger includes a curved portion to permit limited elongation in the radial direction.

5. A gripper mechanism as defined in claim 2, wherein said finger has a pair of oppositely oriented curved portions, wherein engagement with said surface causes one curved portion to contract and the other to expand.

6. A gripper mechanism as defined in claim 5, wherein said curved portions lie on opposite sides of said radius and said finger has upper and lower finger portions, with a connecting portion therebetween, to define a Z-shaped gripper finger.

7. A gripper mechanism as defined in claim 6, wherein said upper and lower finger portion are arranged at approximately 90° to said connecting portion.

8. A collect cylinder for a folding machine for handling sheets of paper, comprising:

a fixed clamping surface on which sheets of paper and the like may be positioned;

gripper means for taking and releasing sheets of paper comprising a holder supported by said collect cylinder and a resilient gripper finger having one end fixed to said holder, wherein said gripper finger terminates in a tip;

means for rotating said holder about an axis for rotating said tip in an arc into engagement with said clamping surface;

wherein said tip lies along a radius extending through said axis;

wherein upon engagement of said tip and surface further rotation causes said surface to impart a counterforce to said tip having a first component perpendicular to said radius and a second component along said radius; and said further rotation causes displacement of said one end relative to said countersurface; and wherein said gripper finger is formed such that the application of said counterforce to said tip causes said gripper finger to deflect, imparting a force to said tip with a radial component which is substantially equal and opposite to said second component of counterforce, thereby producing non-sliding engagement between said gripper tip and said surface.

9. Apparatus as defined in claim 8, wherein said clamping surface is angled toward said tip.

10. Apparatus as defined in claim 9, wherein said tip is beveled for cooperative engagement of said clamping surface.

11. Apparatus as defined in claim 9, wherein said collect cylinder has an outside surface, and said clamping surface is disposed below the outside surface of said cylinder.

12. Apparatus as defined in claim 11, wherein said clamping surface and gripper means comprise a gripper mechanism mounted to said collect cylinder.

13. Apparatus as defined in claim 11, wherein said clamping surface is formed on said collect cylinder.

14. Apparatus as defined in claim 11, wherein said finger includes a curved portion to permit limited elongation in the radial direction.

15. Apparatus as defined in claim 11, wherein said finger has a pair of oppositely oriented curved portions, wherein engagement with said surface causes one curved portion to contract and the other to expand.

16. Apparatus as defined in claim 15, wherein said curved portions lie on opposite sides of said radius and said finger has upper and lower finger portions, with a connecting portion therebetween, to define a Z-shaped gripper finger.

17. Apparatus as defined in claim 16, wherein said upper and lower finger portion are arranged at approximately 90° to said connecting portion.

* * * * *